US010842244B2

(12) United States Patent
Ogrin et al.

(10) Patent No.: US 10,842,244 B2
(45) Date of Patent: Nov. 24, 2020

(54) PORTABLE APPARATUS WITH DEPLOYABLE VISIBILITY ENHANCING SIGNALS

(71) Applicants: Steven Ogrin, Roxborough, CO (US); Alyna Douglass, Roxborough, CO (US)

(72) Inventors: Steven Ogrin, Roxborough, CO (US); Alyna Douglass, Roxborough, CO (US)

( * ) Notice: Subject to any disclaimer, the term of this patent is extended or adjusted under 35 U.S.C. 154(b) by 0 days.

(21) Appl. No.: 16/267,726

(22) Filed: Feb. 5, 2019

(65) Prior Publication Data

US 2019/0239624 A1 Aug. 8, 2019

Related U.S. Application Data

(60) Provisional application No. 62/626,223, filed on Feb. 5, 2018.

(51) Int. Cl.

| | |
|---|---|
| ***A45F 3/04*** | (2006.01) |
| ***G09F 17/00*** | (2006.01) |
| ***G09F 21/02*** | (2006.01) |
| *A45F 3/00* | (2006.01) |

(52) U.S. Cl.

CPC ..... *A45F 3/04* (2013.01); *G09F 17/00* (2013.01); *G09F 21/02* (2013.01); *G09F 21/026* (2013.01); *A45F 2003/003* (2013.01); *A45F 2003/045* (2013.01); *A45F 2200/00* (2013.01); *G09F 2017/0083* (2013.01)

(58) Field of Classification Search

CPC ..... A45F 3/04; A45F 2003/003; A45F 2003/045; A45F 2200/00; A45F 2003/001; A45F 2003/007; A45B 11/02; G09F 21/02; G09F 21/026; G09F 2017/0083; G09F 17/00; B63C 9/20

USPC ..... 224/576

See application file for complete search history.

(56) References Cited

U.S. PATENT DOCUMENTS

| | | | | |
|---|---|---|---|---|
| 3,321,247 | A | 5/1967 | Dillender | |
| 3,946,699 | A * | 3/1976 | Mirshak | G09F 17/00 116/174 |
| 4,553,633 | A | 11/1985 | Armstrong et al. | |
| 5,423,282 | A * | 6/1995 | Krull | B63C 9/115 116/173 |
| 5,439,153 | A * | 8/1995 | Murdoch | A45C 13/002 150/159 |
| 5,651,711 | A | 7/1997 | Samano | |
| 6,289,840 | B1 * | 9/2001 | Hill | B63C 9/20 116/173 |

(Continued)

FOREIGN PATENT DOCUMENTS

| | | |
|---|---|---|
| CN | 107136734 A | 9/2017 |

*Primary Examiner* — Nathan J Newhouse
*Assistant Examiner* — Matthew T Theis
(74) *Attorney, Agent, or Firm* — Williams Intellectual Property; Benjamin F. Williams

(57) ABSTRACT

A portable apparatus with deployable visibility enhancing signals includes a backpack member from which a pair of flag members are deployable to extend up and out of the backpack member behind a wearer's shoulders to resemble wings of a beast or an animal. The flag members incorporate bright, visually distinct fabrics, to increase the visibility profile of the wearer. An elongate member, reminiscent of a tail, may also be incorporated and deployed to dangle behind the wearer to augment the semblance of a winged beast or animal.

15 Claims, 7 Drawing Sheets

(56) References Cited

U.S. PATENT DOCUMENTS

| | | | | |
|---|---|---|---|---|
| 6,536,049 | B2 | 3/2003 | Jastrab et al. | |
| 7,654,218 | B1 | 2/2010 | Marlette | |
| D734,024 | S | 7/2015 | Garcia et al. | |
| 2005/0017041 | A1* | 1/2005 | Roberts | A45F 3/04 224/642 |
| 2008/0045100 | A1 | 2/2008 | Dungan | |
| 2008/0173686 | A1 | 7/2008 | Kennedy | |
| 2011/0092117 | A1 | 4/2011 | Delgado | |
| 2011/0097952 | A1 | 4/2011 | Pirie | |
| 2015/0031007 | A1 | 1/2015 | Ruiz | |

* cited by examiner

PORTABLE APPARATUS WITH DEPLOYABLE VISIBILITY ENHANCING SIGNALS

CROSS-REFERENCE TO RELATED APPLICATIONS

This nonprovisional application for utility patent claims the benefit of provisional application No. 62/626,223, filed on Feb. 5, 2018.

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Various means of rendering a person more visible when skiing, snowboarding, or when engaging in other outdoor activities are known in the art. The present portable apparatus with deployable visibility enhancing signals has been devised to increase a wearer's visibility profile in a fun and effective manner, to lessen chances of collision with the wearer while engaged in outdoor pursuits (such as skiing and snowboarding) while enabling ready identification of the wearer among crowds, on crowded outdoor spaces where sporting and other activities are being undertook by multiple persons (such as, but not limited to, a ski run). Further, the present portable apparatus with deployable visibility enhancing signals includes fungible elements to enable interchange of said elements to match, contrast, update the present apparatus or to signal attainment of a particular proficiency, for example, or membership in a particular group or class, as case may be.

FIELD OF THE INVENTION

The present invention relates to a portable apparatus with deployable visibility enhancing signals devised to increase the wearer's visibility profile in a fun manner. The present invention includes a wearable backpack member from whence a pair of deployable flag members is extendible. The pair of deployable flag members are contemplated to be rendered of bright and distinctively colored fabric and to include a form that bears semblance to wings of a mythical beast (such as a dragon) or other animal. Motion of the flag members during movement or speed of the wearer, therefore, may further increase the visibility profile of the wearer while simultaneously increasing the semblance of flapping wings, for example. Thus the invention relates to signal apparatuses, visibility apparatuses, as well as portable containers for outdoor pursuits. While not necessarily limited to such an application, the present invention may be particularly useful in the skiing and snowboarding arts, particularly for parents with young children and ski or snowboard instructors teaching young students snow sports.

SUMMARY OF THE INVENTION

The present portable apparatus with deployable visibility enhancing signals has been devised to increase the visibility profile of a wearer when a pair of deployable flag members is disposed in a deployed position. The term "visibility profile", as used herein throughout, is taken to mean the relative perceived visibility of a person. For example, when oriented against a dark background or field of view, a person wearing brighter colors will have a higher visibility profile than a person wearing darker colors. The term also includes the personal space surrounding a person. Thus a person with their arms extended outwards will have a higher visibility profile relative a person with arms by their side. Thus the term "visibility profile" is taken to mean both the aesthetic contrast of a person relative a background or field of view as well as the visual space the person occupies within a given field of view.

The present portable apparatus with deployable visibility enhancing signals has been devised for use on outdoor terrain, such as when hiking or skiing, for example, whereby a person's visibility profile may be increased to lessen chances of impact with other hikers or skiers, for example, and to render the person more visibly distinct and therefore identifiable even when active upon a crowded run or at a considerable distance. In an example embodiment, the present portable apparatus with deployable visibility enhancing signals is rendered to resemble a dragon or other winged animal or creature, whereby the wearer is rendered visible in a fun and enjoyable manner. In other embodiments of the present device, color coding of the elements incorporating the features of the invention as set forth below is contemplated to provide a uniformity among wearers particularly effected to identify members of the same class or group, for example. Instructors employing the present invention to assist in maintaining identity of their class participants, therefore, may be facilitated in demarking their students for ease of coordinating the class as a whole on slope, in crowds, and elsewhere as case may be. Further, certain elements of the present invention may be interchanged to represent different levels, skills, proficiencies, attainments, or other indication of rank or status or attainment, whereby specific wearers may be identified as having acquired a certain level or proficiency in a similar capacity as to attaining a patch or badge, say.

While the present portable apparatus with deployable visibility enhancing signals has been devised principally for use with children, so that parents and/or instructors are easily able to identify their children or students on slope or while engaging in other appropriate outdoor sporting activities, it should be understandable by a person of ordinary skill in the art that the present invention is not necessarily restricted for use with children only.

The portable apparatus with deployable visibility enhancing signals, therefore, is wearable by a wearer. A pair of deployable flag members is extensible from out of a backpack member, to position like wings projected above and behind the wearer's shoulders. Because the portable apparatus with deployable visibility enhancing signals is devised for use on the slopes and in cold weather (as well as in other terrain and climates) deployment of the pair of flag members has been devised to not require dexterity—the flag members may be deployed to the deployed position even by a person wearing gloves or mittens. Access into the backpack member to retrieve and deploy the flag members is likewise enabled to facilitate access to the deployable flag members so that a person wearing gloves or mittens is able to access and deploy the flag members expeditiously without removing the gloves or mittens. The device therefore enables a parent, for example, to rapidly deploy the flag members to increase the visibility profile of their child with facility, for example, when arriving at the top of a ski run and previous to setting off downslope.

The portable apparatus with deployable visibility enhancing signals, therefore, includes a backpack member portable upon a wearer's back. The backpack member may be sized appropriate to minimize overall size, to be lightweight, and to fit to the back of a child. The backpack member includes a backpack body, a pair of waist straps connectable together to encircle the waist of the wearer, a pair of shoulder straps, a pair of connectable chest straps disposed to interconnect the pair of shoulder straps and fasten together in a position proximal the wearer's sternum, an interior cavity, and a rearmost cover flap fastenable to enclose the interior cavity and positionable between an open and closed position.

The rearmost cover flap includes an uppermost portion that rapidly attaches to the backpack body, proximal the top corners of the backpack body or to the shoulder straps proximal the top corners of the backpack body. The rearmost cover flap is devised to readily fasten and unfasten from the closed position to the open position. Fastening may be effected by hook and loop fasteners, snap buttons, and other rapid fastening and unfastening means operable by a person wearing gloves or mittens. Thus minimal force applied to pull at the uppermost portion of the rearmost cover flap enables movement of the rearmost cover flap to the open position and reveals the interior cavity wherein the pair of deployable flag members are accessible. Return of the rearmost cover flap to the closed position is effected with similar facility when the pair of deployable flag members are returned to the stowed position by contact of the uppermost portion with the backpack body to effect refastening thereto, either be engagement of hook and loop fasteners or other contact-effective fastening means.

Each of the pair of deployable flag members is disposed at an end of a bendable rod anchored medially interior to the backpack member along a lowermost portion of the interior cavity. The bendable rod may be made of lightweight, tubular aluminum, or other flexible, lightweight material that enables bendable position and reposition without the rod resisting reposition or elastically rebounding to a former position, and without repeated bending appreciably weakening the rod during frequent use.

The bendable rod projects its pair of ends up sides of the interior cavity of the backpack member. The bendable rod's ends are positionable between a curled position, curled interior to the interior cavity, and an extended position, extended up and out of the interior cavity above the backpack member (when the rearward cover flap is moved to the open position). Thus each of the pair of deployable flag members is movable from the stowed position interior to the backpack member and the deployed position when the ends of the bendable rod are moved to the extended position.

The bendable rod may be securable to the interior cavity of the backpack member in fabric sleeves disposed upon the backpack body. The fabric sleeves may be attachable to the backpack body by action of hook and loop fasteners or other convenient means of securement, whereby the bendable rod is removable from the interior cavity when desired, such as for replacement or repair for example, or when desiring to wash the backpack member.

Each of said pair of deployable flag members have visually bright and distinctive coloring. When moved to the deployed position, disposed extended out from the backpack on either side of the wearer in a coronal plane relative to the wearer and in a position rearwards and diagonally above the wearer's shoulders, the flag members may resemble wings of a mythical beast, bird, or other animal. The flag members are typically rendered of a strikingly bright or fluorescent fabric that increases the visibility profile of the wearer and defines the boundaries of the wearer's personal space. The fabric may include design elements to increase the semblance to wings.

In some embodiments, to make the present portable apparatus with deployable visibility enhancing signals more fun to wear, the rearmost cover flap may include an elongate member reminiscent of a tail. In such embodiments, the elongate member may be disposed upon an interior side of the rearmost cover flap wherein the elongate member is thence extensible rearwardly and downwardly from the backpack member when the uppermost portion of the rearmost cover flap is inverted and the rearmost cover flap is disposed in the open position. The wearer's visibility profile is further increased, therefore, by projection of the elongate member rearwardly and downwardly from the backpack member and the elongate member also creates the appearance of a tail matched to the appearance of wings made by the pair of deployable flag members. The elongate member may likewise employ bright and visually distinct fabrics.

In another embodiment of the present portable apparatus with deployable visibility enhancing signals, the elongate member may be attached or attachable at a lowermost portion of the backpack body upon a front side thereof. The elongate member may be stowed interior to a pocket member disposed centrally upon the front side of the back pack portion and then deployed therefrom. This embodiment enables the wearer to close the rearmost cover flap with the pair of deployable wing members and the elongate member deployed, and returning the rearmost cover flap to the closed position presents any design elements as may be incorporated upon the rearmost cover flap to passersby to complete the semblance of a winged beast or animal.

Thus has been broadly outlined the more important features of the present portable apparatus with deployable visibility enhancing signals so that the detailed description thereof that follows may be better understood and in order that the present contribution to the art may be better appreciated.

Objects of the present portable apparatus with deployable visibility enhancing signals, along with various novel features that characterize the invention are particularly pointed out in the claims forming a part of this disclosure. For better understanding of the portable apparatus with deployable visibility enhancing signals, its operating advantages and specific objects attained by its uses, refer to the accompanying drawings and description.

BRIEF DESCRIPTION OF THE DRAWINGS

Figures

DETAILED DESCRIPTION OF THE DRAWINGS

With reference now to the drawings, and in particular FIGS. 1 through 13 thereof, example of the instant portable apparatus with deployable visibility enhancing signals employing the principles and concepts of the present portable apparatus with deployable visibility enhancing signals and generally designated by the reference number 10 will be described.

Referring to FIGS. 1 through 13 example embodiments of the present portable apparatus with deployable visibility enhancing signals 10 are illustrated.

Figure 1:
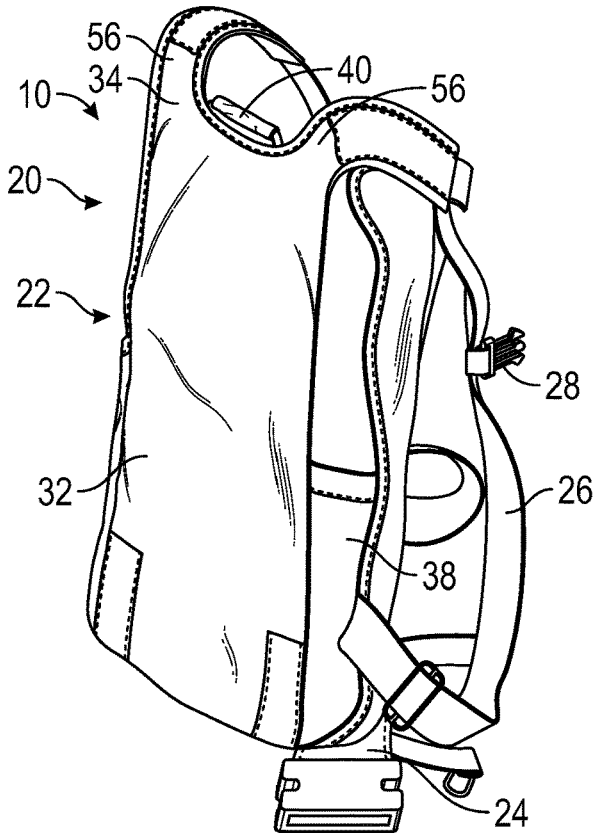
FIG. 1 is an isometric view of an example embodiment.
Figure 2:
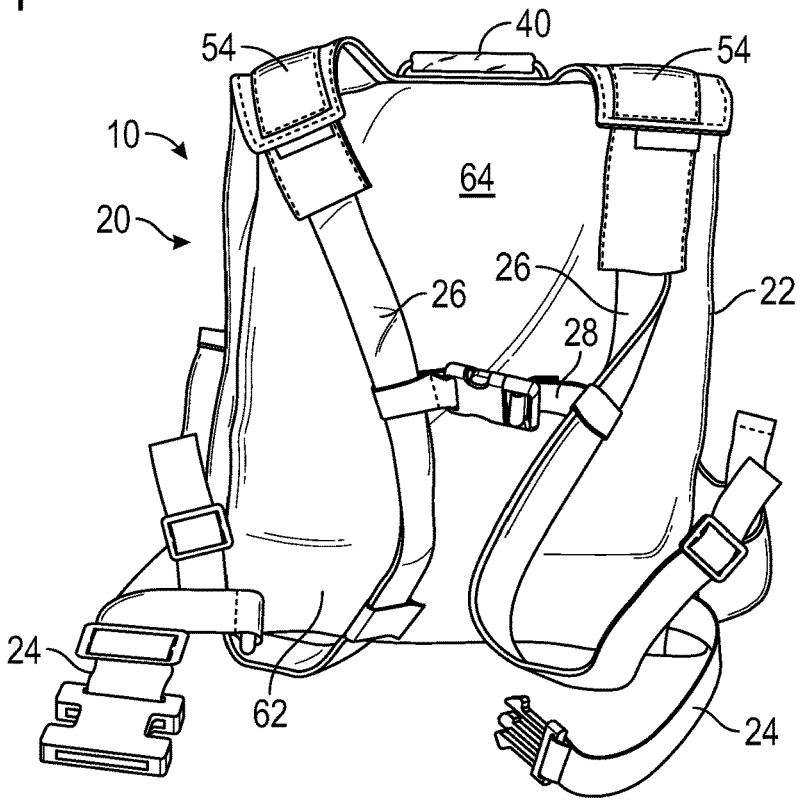
FIG. 2 is a front elevation view of an example embodiment.

FIGS. 1 and 2. Illustrate an example embodiment of a backpack member 20 wearable upon a wearer's back in the manner typically seen in the art. The backpack member 20 includes a backpack body 22, a pair of waist straps 24, a pair of shoulder straps 26, and a pair of connectable chest straps 28 rendered to secure the backpack member to the back of the wearer. Since the present portable apparatus with deployable visibility enhancing signals 10 is devised for use out of doors, for example when skiing or snowboarding, or hiking in the wilderness, securement of the backpack member 20 to the wearer is important so that the backpack member does not dislocate from the wearer, during physical activity, when moving fast downslope, of during a fall for example.

As is seen in the art, each of the pair of waist straps 24 is connectable together to encircle the waist of the wearer and secure thereto by action of a releasable clip or buckle. Each of the pair of shoulder straps 26 is devised to support the backpack member 20 upon the wearer's back by engaging against the wearer's shoulders. Each of the pair of chest straps 28 is fastenable together to interconnect the pair of shoulder straps 26 in a position proximal the sternum of the wearer.

An interior cavity 30 of the backpack member is covered and enclosed by a rearmost cover flap 32. The rearmost cover flap 32 is expediently deployable between a closed position and an open position, and is devised for ease of use even for a person wearing gloves or mittens. The rearmost cover flap 32 releasably attaches an uppermost portion to the backpack body 20 proximal the top corners of the backpack body 22. The uppermost portion 34 of the rearmost flap cover 32 is rapidly disconnectable from engagement with the backpack body 22 to enable rapid access to the interior cavity 30 by gently forcing the uppermost portion 34 away from the backpack body 20. When moved to the open position the rearmost cover flap 32 may become inverted to expose an interior side 36 of the uppermost portion 34.

The backpack member 20 may further include lateral pockets 38, disposed upon sides of the backpack body 20, or other pockets disposed upon the rearmost cover flap 32 or even interior to the interior cavity 30. A handle member 40 may be disposed upon a top portion of the backpack body 20 in a position behind the nape of the neck of the wearer to assist in aiding the wearer regaining their feet after falling, for example. Such a handle member 40 may be useful for ski and snowboard instructors, for example, or parents with younger students learning to ski or snowboard.

Figure 3:
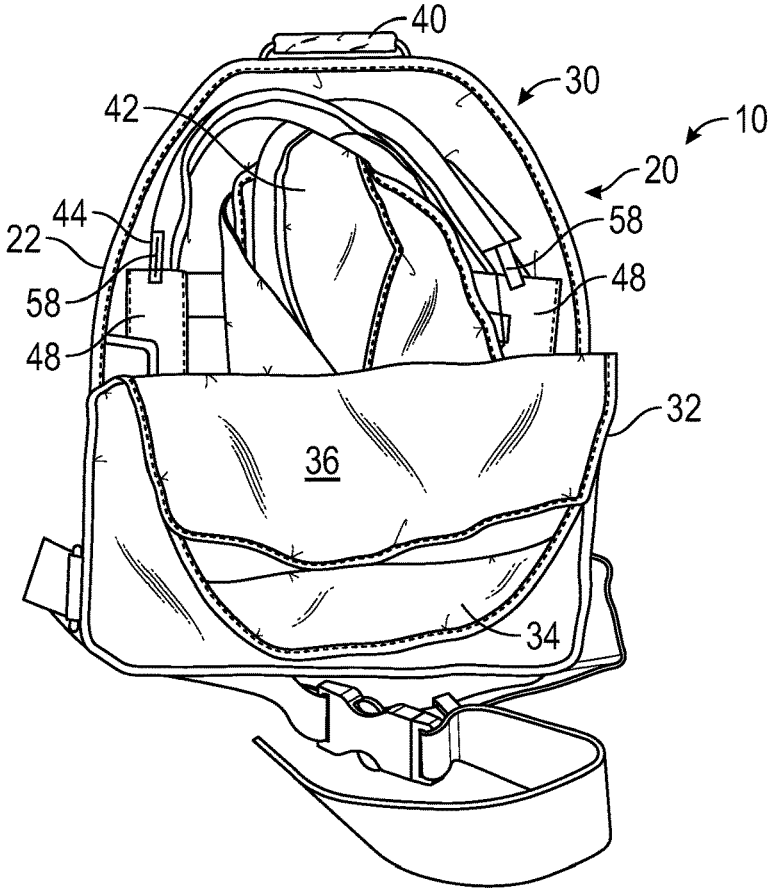
FIG. 3 is a rear, raised elevation view of an example embodiment with a rearmost cover flap in an open position.

FIG. 3 illustrates an example embodiment of the backpack member 20 having the rearmost cover flap 32 disposed in the open position. The interior cavity 30 is therefore revealed and the pair of deployable flag members 42 is accessible for deployment to the deployed position. Each of the pair of flag members 42 is disposed upon opposing ends of a bendable rod 44. The bendable rod 44 is devised to be pliable and easily moved from a curled position to an extended position. The bendable rod 44 is medially anchored to a lowermost portion of the interior cavity 30 and projects ends 46 up either side of the interior cavity 30. The bendable rod 44 may be anchored to the backpack body 20 by insertion through fabric sleeves 48. Some or all of these fabric sleeves 48 may be releasably fastenable to sections of the backpack body 20, as by action of hook and loop fasteners, for example (see FIG. 9 for example).

Figure 4:
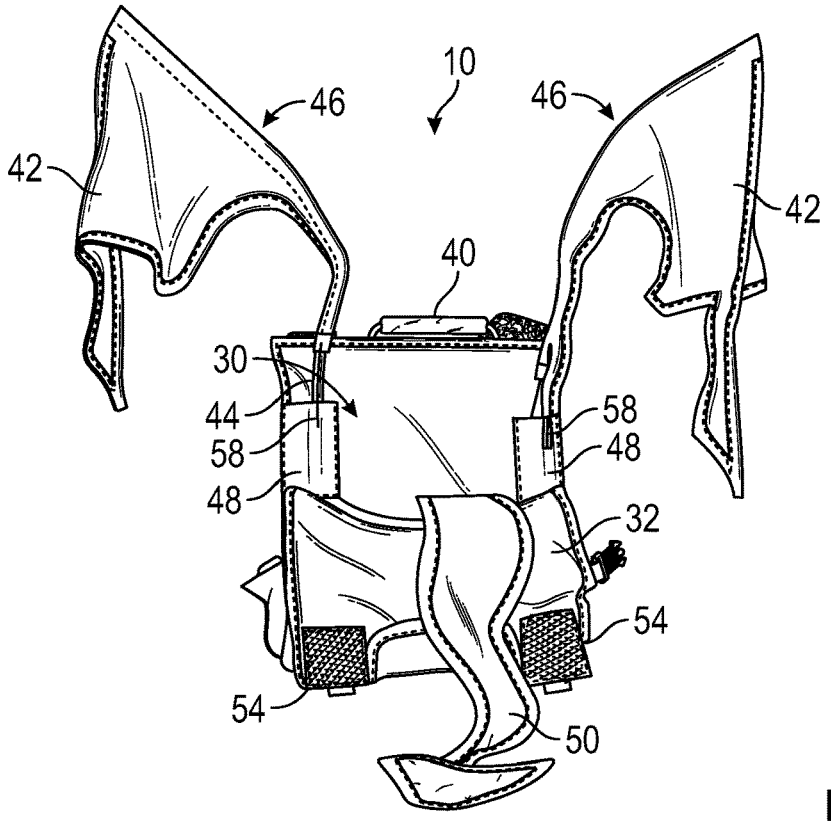
FIG. 4 is a rear elevation view of an example embodiment showing each of the pair of flag members in the deployed position and the elongate member deployed from the interior side of the rearmost cover flap.

The bendable rod 44 may be grasped by a user wearing gloves or mittens, and readily moved to the extended position. As shown in FIG. 4, the extended position disposes the deployable flag members 42 extended upwardly out of the interior cavity 30 to resemble wings behind the wearer. Motion of the pair of deployable flag members 42 during locomotion, skiing, or movement by the wearer, may enhance the semblance of the flag members 42 to wings.

As also shown in FIG. 4, in some embodiments of the present invention 10, the rearmost flap cover 32 may include an elongate member 50 attached and/or attachable to the interior side 36 thereof. The elongate member 50 may therefore be deployed downwardly rearwards of the wearer when the rearmost flap cover 32 is moved to the open position to further increase the visibility profile of the wearer. The elongate member 50 may be devised to resemble a tail, consonant and conformant with the appearance of the backpack member 20 and the pair of deployable flag members 42. The elongate member 50 may therefore employ brightly distinct fabric elements devised to resemble, augment, or contrast with the appearance of the pair of deployable flag members 42. The elongate member 50 may attach to an attachment point 52 on the interior side 36 of the rearmost cover flap 32 by action of hook and loop, for example, or other fastener capable of securing the elongate member 50 in position. Thus the elongate member 50 may be a fungible element devised fro addition to the backpack member 20 to further augment a desired appearance, or as an addition to signal accomplishment, say, attainment of a particular level or proficiency, for example.

Figure 5:
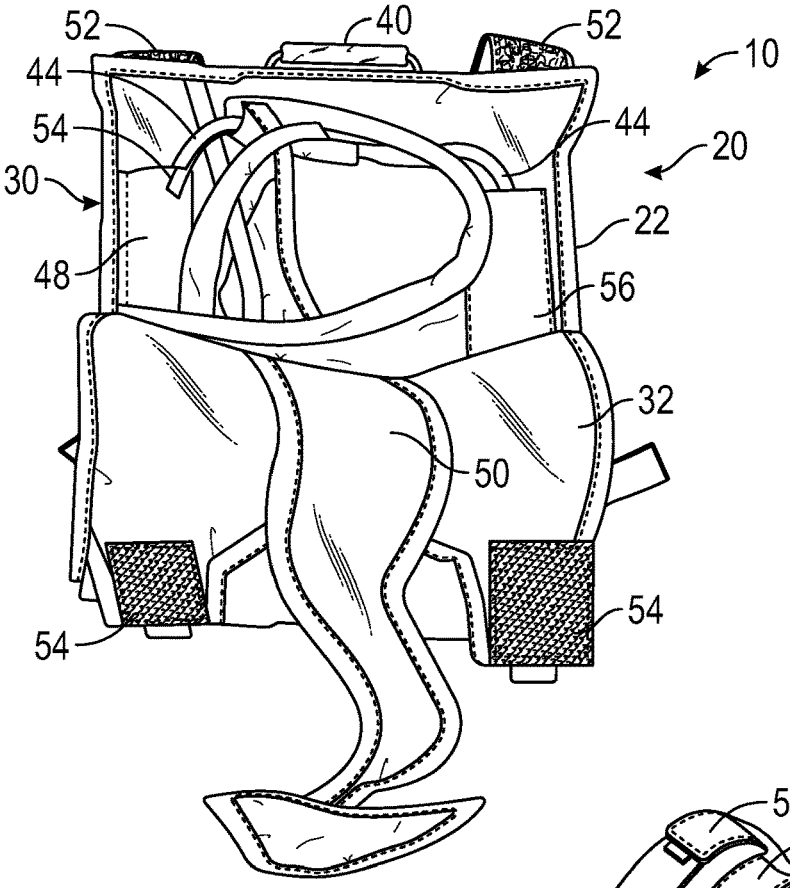
FIG. 5 is a rear elevation view of an example embodiment with the rearmost cover lap in the open position, but with each of the pair of flag members disposed in the stowed position (the pair of bendable rods in the curled position) and the elongate member is extended.

The example embodiment shown in FIG. 5 illustrates the elongate member 50 not deployed from the rearmost cover flap 32 when the rearmost cover flap 32 is nonetheless disposed in the open position. FIG. 5 also illustrates the pair of flag members 42 disposed in the stowed position and ends of the bendable rod 44 disposed in the curled position. Once the rearmost cover flap 32 is moved to the open position, a user may easily grasp the bendable rod 44, even when gloved or wearing mittens, to uncurl the ends 46 into the extended position and thereby deploy the pair of deployable flag members 42.

Figure 6:
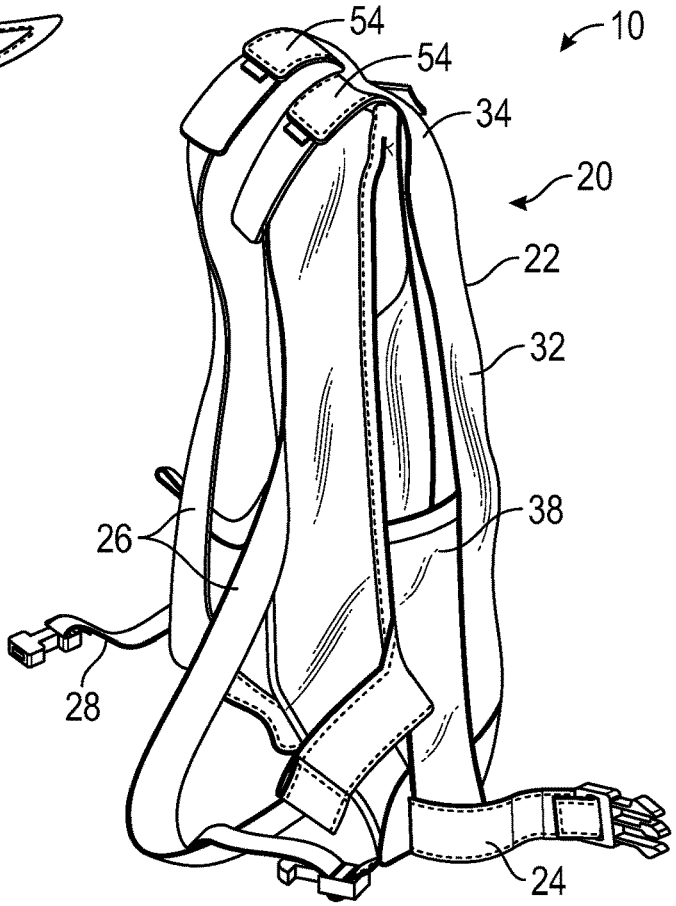
FIG. 6 is a side elevation view.
Figure 7:
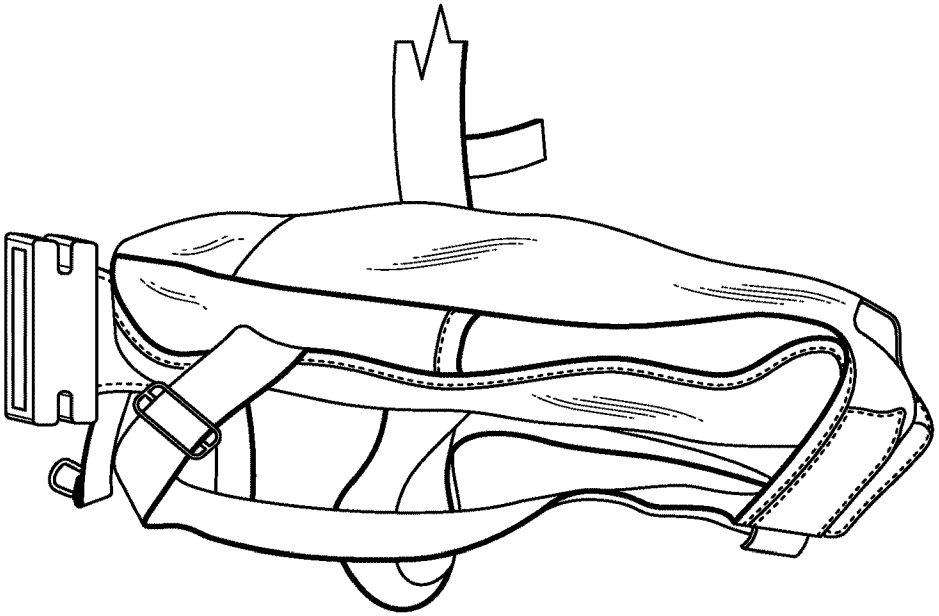
FIG. 7 is a side elevation view.

FIG. 6 illustrates an example embodiment from a side view whereby lateral pocket 38 is shown. Attachment members 54 of the uppermost portion 34 of the rearmost cover flap 32 are also shown fastened to corresponding portions of the shoulder straps 26 proximal the uppermost corners 56 of the backpack body 22. FIG. 7 likewise illustrates an example embodiment of the backpack body 22 viewed from the other side.

Figure 8:
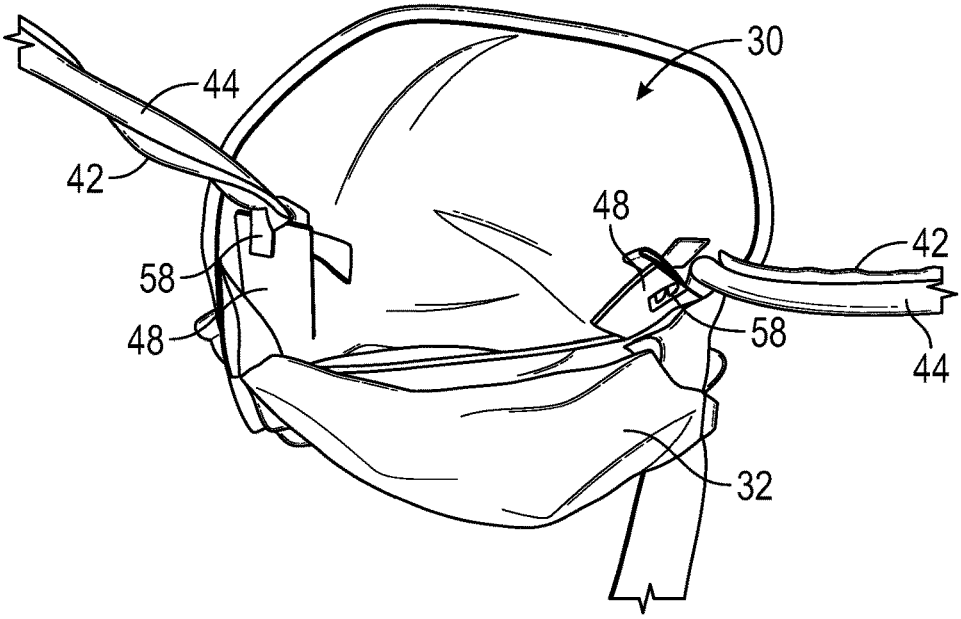
FIG. 8 is a detail view of example embodiments of sleeves supportively maintaining ends of the bendable rod in position interior to the interior cavity of the backpack body.

FIG. 8 illustrates a close up view of an example embodiment of fabric sleeves 48 securing the bendable rod 44 to sides of the backpack body 22. Portion 58 may be disposed to secure each flag member 42 to the bendable rod 44 end 46 by engagement with the associated fabric sleeve 48. Detachment of portion 58 may allow removal of the flag member 42 from the bendable rod 44 to enable interchange of other flag members 42, as may be desired when rendering a group of wearers uniformly for identification upon the slopes, for example, or when the wearer upgrades a skill level such as, for example, becoming an advanced or expert skier capable of skiing black runs versus an intermediate, double blue skier for example. Thus the deployable flag members 42 may be interchanged to serve as a patch or visually distinct indicator of a particular wearer's proficiency or skill level, affiliation, or other marker of progress, ability, membership, origin, or other signal in addition to increasing the said wearer's visibility profile.

Figure 9:
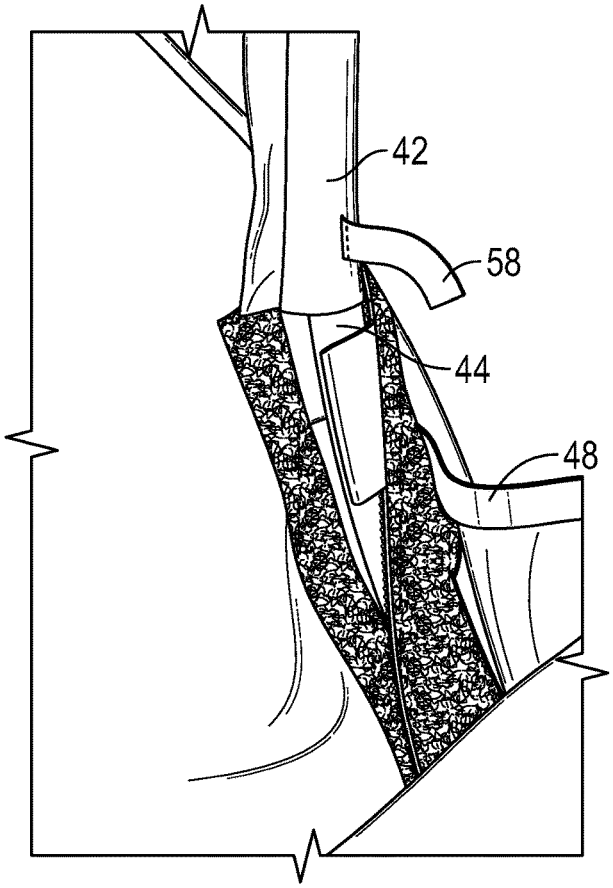
FIG. 9 is a detail view illustrating attachment and detachment of an example embodiment of a sleeve to the backpack body.

FIG. 9 illustrates a detailed view of an example embodiment of the fabric sleeves 48 having engagement to the backpack body 22 by action of hook and loop fasteners. In such embodiments, removal of some or all of the fabric sleeves 48 may be effected to enable removal of the bendable rod 44 expeditiously. Additionally, the flag members 42 may be removable from ends 46 of the bendable rod 44 to facilitate unthreading of the bendable rod 44 through the fabric sleeves 48, or to change out the deployable flag members 42 as a fungible design element (as when, for example, rendering a group or wearers uniform for purposes of grouping or identification).

Figure 10:
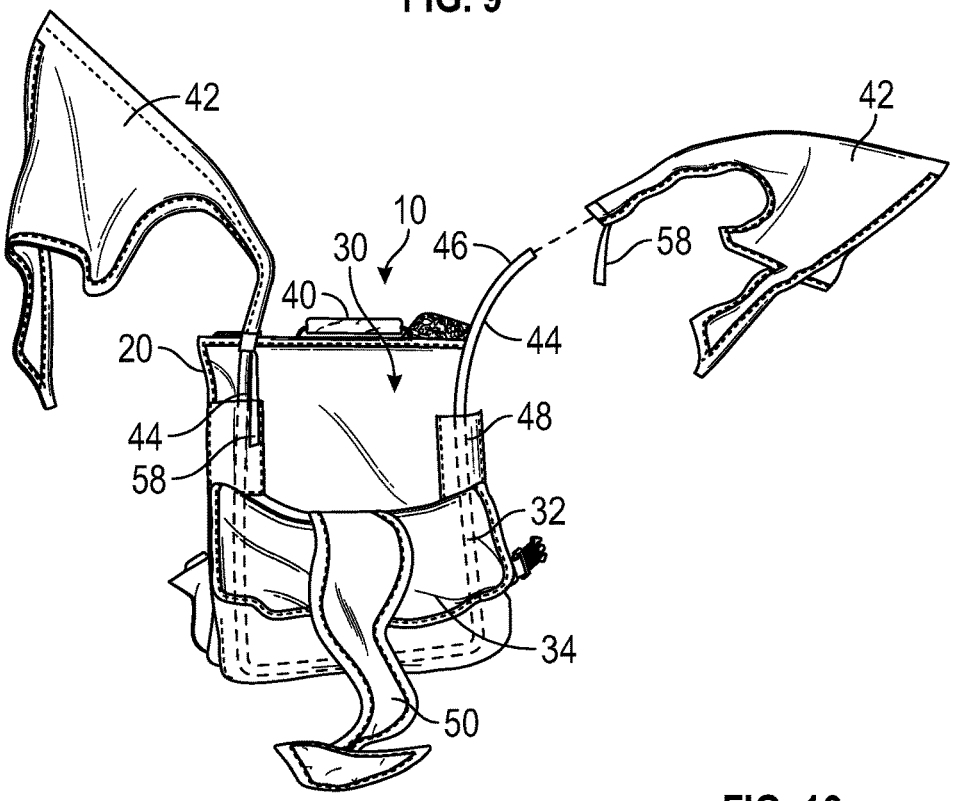
FIG. 10 is a rear elevation view showing the position of the bendable rod within the interior cavity.

FIG. 10 illustrates an example embodiment of the position of the bendable rod 44 disposed interior to the interior cavity 30. The bendable rod 44 is medially conformed to the lowermost portion 60 of the interior cavity 30 and extends ends 46 up either side of the interior cavity 30. The pair of flag members 42 is removable from ends 46 of the bendable rod 44 when portion 58 is unfastened.

Figure 11:
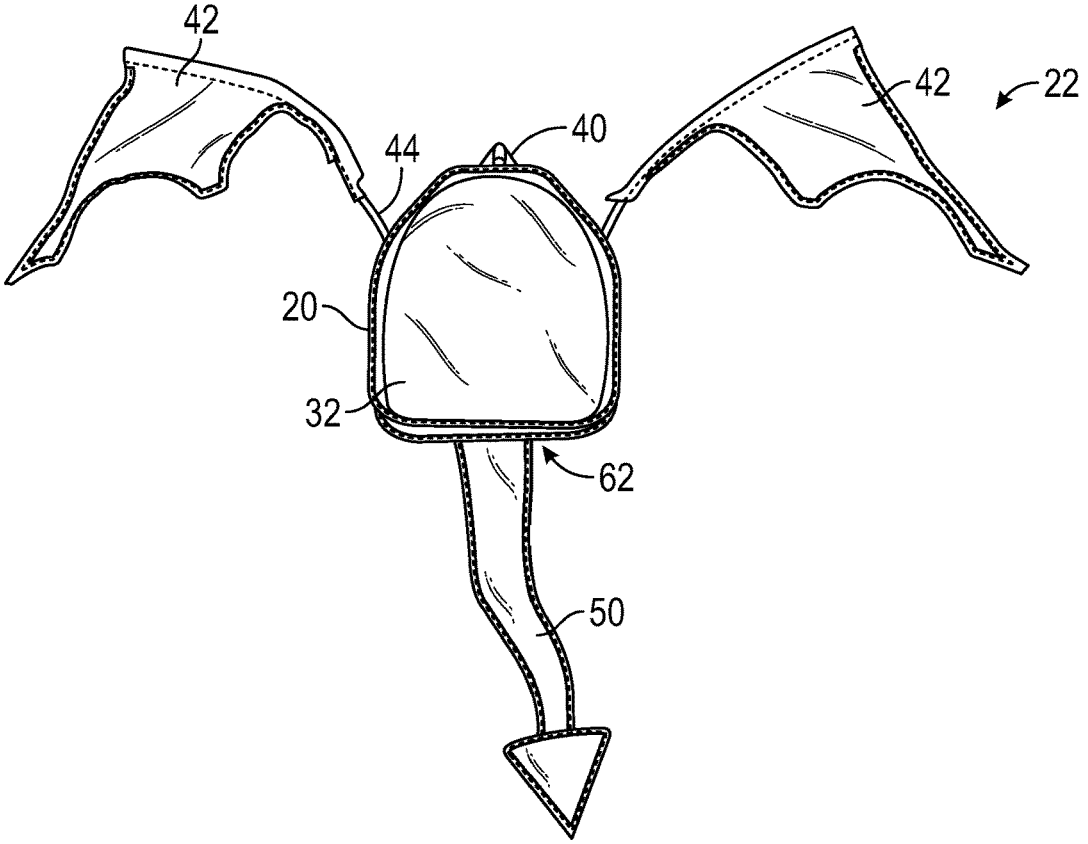
FIG. 11 is a rear elevation view of another example embodiment having the pair of wing members disposed in the deployed position, the rearmost cover flap closed, and the elongate member, attached to the lowermost portion of the front side of the backpack body, extended.

FIG. 11 illustrates another example embodiment with each of the pair of deployable flag members 42 disposed in the deployed position. In this particular embodiment, the elongate member 50 is disposed attached to a lowermost portion 62 of the front side 64 of the backpack body 22, and is therefore deployable even when the rearmost cover flap 32 is returned to the closed position. The rearmost cover flap 32 may include design elements (such as patterns resembling dragon's scales, for example, or the feathers of a bird) whereby closure of the rearmost cover flap 32 maintains the semblance of a winged beast or animal.

Figure 12:
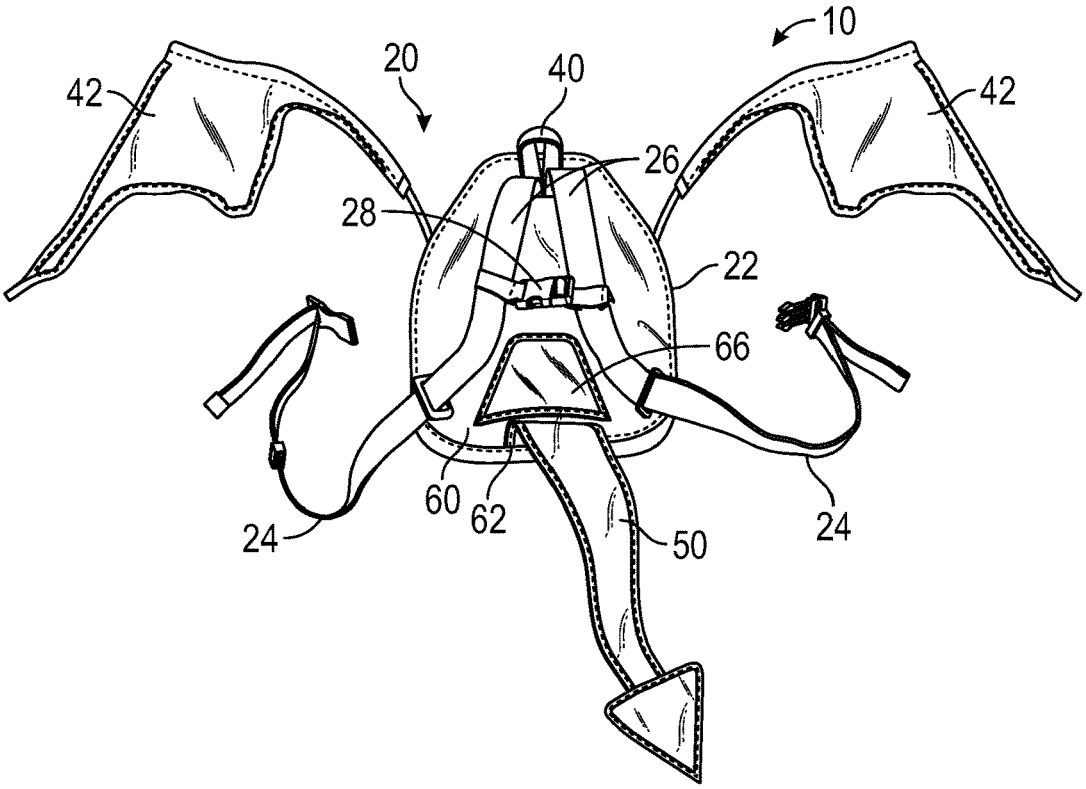
FIG. 12 is a front elevation view of the other example embodiment showing the pocket member disposed upon the front side of the backpack body, into which pocket member the elongate member may be stowed.

FIG. 12 illustrates this other embodiment as shown in FIG. 11 from the front side. An elastic pocket member 66 is disposed upon the front side 64 of the backpack body 22 wherein the elongate member 50 is storable. The elongate member 50 is thus deployable from a furled or rolled or folded position interior to the pocket member 66 to dangle behind the wearer when in use.

Figure 13:
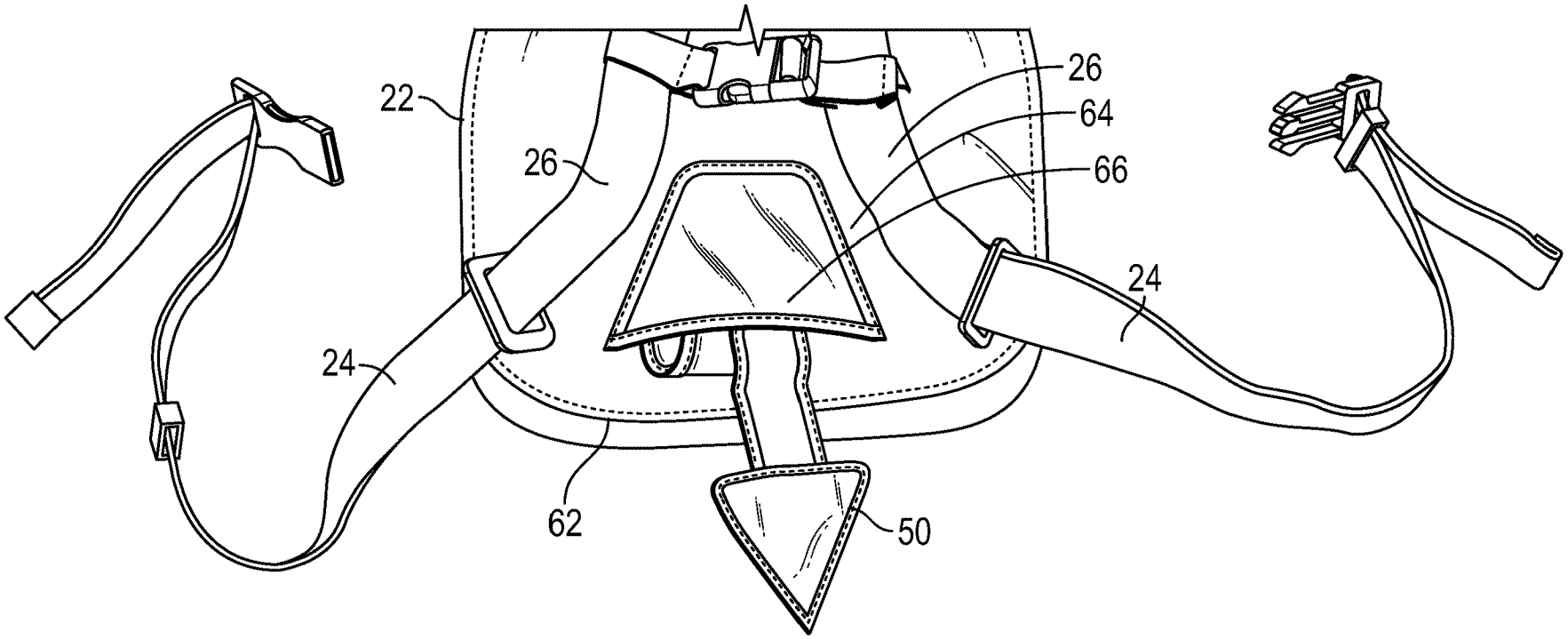
FIG. 13 is a raised elevation view of the other example embodiment detailing stowage and extension of the elongate member from the pocket member.

FIG. 13 illustrates the embodiment depicted in FIGS. 11 and 12 having the elongate member 50 deployed from a furled position interior to the pocket member 66 to an unfurled position, extended from the lowermost portion 62 of the backpack body 22 front side 64 to dangle behind the user in use.

What is claimed is:

1. A portable apparatus with deployable visibility enhancing signals comprising:

a backpack member portable upon a wearer's back, said backpack member having an interior cavity; and a pair of deployable flag members disposed inside of the interior cavity, each of said pair of deployable flag members, disposed endwise upon at least one bendable rod, said at least one bendable rod malleable to be manually positionable between a stowed position and a deployed position without resisting or elastically rebounding to a former position;

wherein the pair of deployable flag members is moveable between the stowed position, concealed interior to the interior cavity, and the deployed position, disposed extended out from the back pack extending in a coronal plane relative to the wearer in a position rearwards and diagonally above the wearer's shoulders to increase the wearer's visibility profile.

2. The portable apparatus with deployable visibility enhancing signals of claim 1 wherein the bendable rod is anchored medially interior to the backpack member along a lowermost portion of the interior cavity, said bendable rod projecting each end up sides of the interior cavity, wherein the ends of the bendable rod are bent down interior to the interior cavity when the flag members are disposed in the stowed position, and wherein the ends of the bendable rod are straightened out to extend up from the interior cavity, and outside of the backpack member, in a coronal plane relative to the wearer, whereby the flag members are positioned rearwards and diagonally above the wearer's shoulders when disposed in the deployed position.

3. The portable apparatus with deployable visibility enhancing signals of claim 2 wherein the backpack member further comprises:

a backpack body;

a pair of waist straps connectable together to encircle the waist of the wearer, each of said pair of waist straps attached endwise to a front side of the backpack body at a lowermost corner thereof and fastenable together girding the wearer;

a pair of shoulder straps, each of said pair of shoulder straps connected endwise at a corresponding top corner of the front side of the backpack body, each of said pair of shoulder straps connected at a lowermost end to the backpack body;

a pair of connectable chest straps fastenable together to interconnect the pair of shoulder straps; and a rearmost cover flap disposed to enclose the interior cavity, said rearmost cover flap having an uppermost portion attachable to the backpack body proximal the top corners, said rearmost cover flap positionable between a closed position and an open position;

wherein detachment of the uppermost portion of the rearmost cover flap enables rapid deployment of the flag members from within the interior cavity.

4. The portable apparatus with deployable visibility enhancing signals of claim 3 wherein the backpack body includes an elongate member deployable rearwardly from the backpack member, said elongate member deployable to further increase the wearer's visibility profile.

5. The portable apparatus with deployable visibility enhancing signals of claim 3 wherein the bendable rod is securable to the interior cavity in fabric sleeves disposed upon the backpack body.

6. The portable apparatus with deployable visibility enhancing signals of claim 4 wherein the elongate member is disposed upon an interior side of the rearmost cover flap wherein the elongate member is extensible rearwardly and downwardly from the backpack member when the rearmost cover flap is disposed in the open position, whereby the wearer's visibility profile is further increased by projection of the elongate member rearwardly and downwardly from the backpack member.

7. The portable apparatus with deployable visibility enhancing signals of claim 4 wherein the elongate member is disposed upon a lowermost portion of the front side of the backpack body whereby the elongate member is deployable dangling behind the wearer even when the rearmost cover flap is closed.

8. The portable apparatus with deployable visibility enhancing signals of claim 5 wherein the fabric sleeves are attachable to the backpack body by action of hook and loop fasteners whereby the bendable rod is removable from the interior cavity.

9. The portable apparatus with deployable visibility enhancing signals of claim 7 wherein the backpack body further includes a pocket member disposed upon the front side wherein the elongate member is storable.

10. A portable apparatus with deployable visibility enhancing signals comprising:

a backpack member portable upon a wearer's back, said backpack member including:

a backpack body;

a pair of waist straps connectable together to encircle the waist of the wearer, each of said pair of waist straps attached endwise to a front side of the backpack body at a lowermost corner thereof and fastenable together girding the wearer;

a pair of shoulder straps, each of said pair of shoulder straps connected endwise at a corresponding top corner of the front side of the backpack body, each of said pair of shoulder straps connected at a lowermost end to the backpack body;

a pair of connectable chest straps fastenable together to interconnect the pair of shoulder straps; and a rearmost cover flap disposed to enclose the interior cavity, said rearmost cover flap having an uppermost portion attachable to the backpack body proximal the top corners, said rearmost cover flap positionable between a closed position and an open position;

an interior cavity;

a malleable, bendable rod anchored medially interior to the backpack member along a lowermost portion of the interior cavity, said bendable rod projecting each of a pair of ends up sides of the interior cavity, said bendable rod having a pair of ends positionable between a curled position, curled interior to the interior cavity, and an extended position, extended up and out of the interior cavity above the backpack member when the rearward cover flap is moved to the open position, said bendable rod is lightweight and repeatedly moveable to position and reposition without resisting or elastically rebounding to a former position;

a pair of deployable flag members disposed at a corresponding one of the pair of ends of the bendable rod, each of said deployable flag members moveable between a stowed position, concealed interior to the interior cavity, and a deployed position, disposed extended out from the back pack extending in a coronal plane relative to the wearer in a position rearwards and diagonally above the wearer's shoulders;

wherein each of the pair of deployable flag members is moveable to the deployed position to increase the wearer's visibility profile.

11. The portable apparatus with deployable visibility enhancing signals of claim 10 wherein the rearmost cover flap includes an elongate member, said elongate member disposed upon an interior side of the rearmost cover flap wherein the elongate member is extensible rearwardly and downwardly from the backpack member when the rearmost cover flap is disposed in the open position, whereby the wearer's visibility profile is further increased by projection of the elongate member rearwardly and downwardly from the backpack member.

12. The portable apparatus with deployable visibility enhancing signals of claim 11 wherein the elongate member is disposed upon a lowermost portion of the front side of the backpack body whereby the elongate member is deployable dangling behind the wearer even when the rearmost cover flap is closed.

13. The portable apparatus with deployable visibility enhancing signals of claim 11 wherein the bendable rod is securable to the interior cavity in fabric sleeves disposed upon the backpack body.

14. The portable apparatus with deployable visibility enhancing signals of claim 12 wherein the backpack body further includes a pocket member disposed upon the front side wherein the elongate member is storable.

15. The portable apparatus with deployable visibility enhancing signals of claim 13 wherein the fabric sleeves are attachable to the backpack body by action of hook and loop fasteners whereby the bendable rod is removable from the interior cavity.

* * * * *